US007784499B2

(12) United States Patent
Gesing et al.

(10) Patent No.: US 7,784,499 B2
(45) Date of Patent: Aug. 31, 2010

(54) SHAFT CONNECTING DEVICE FOR A HEALD SHAFT

(75) Inventors: Karl-Heinz Gesing, Raesfeld (DE); Johannes Bruske, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 54 days.

(21) Appl. No.: 12/147,101

(22) Filed: Jun. 26, 2008

(65) Prior Publication Data

US 2009/0000687 A1 Jan. 1, 2009

(30) Foreign Application Priority Data

Jun. 26, 2007 (EP) ..... 07012444

(51) Int. Cl.
*D03C 9/06* (2006.01)
*D03C 13/00* (2006.01)

(52) U.S. Cl. ..... 139/55.1; 139/35; 139/56; 139/57; 139/58; 139/91

(58) Field of Classification Search ..... 139/35, 139/55.1, 56–58, 82–91
See application file for complete search history.

(56) References Cited

U.S. PATENT DOCUMENTS

| | | | | |
|---|---|---|---|---|
| 4,083,385 | A * | 4/1978 | Pfarrwaller | 139/57 |
| 5,050,644 | A * | 9/1991 | Peter | 139/88 |
| 5,063,971 | A * | 11/1991 | Peter | 139/87 |
| 5,082,029 | A * | 1/1992 | Dornier | 139/1 E |
| 5,518,040 | A * | 5/1996 | Rupflin | 139/57 |
| 5,810,055 | A * | 9/1998 | Haeussler et al. | 139/57 |
| 6,460,577 | B1 * | 10/2002 | Krumm | 139/57 |
| 7,475,708 | B2 * | 1/2009 | Bruske et al. | 139/55.1 |
| 2002/0124901 | A1 * | 9/2002 | Krumm | 139/57 |
| 2005/0081942 | A1 * | 4/2005 | Schwane et al. | 139/92 |
| 2006/0070680 | A1 * | 4/2006 | Mettler | 139/93 |
| 2007/0009319 | A1 * | 1/2007 | Drope et al. | 403/11 |

FOREIGN PATENT DOCUMENTS

| | | |
|---|---|---|
| DE | 9103031 | 3/1991 |
| DE | 102004047929 | 12/2005 |
| EP | 0520540 | 12/1992 |

* cited by examiner

*Primary Examiner*—Bobby H Muromoto, Jr.
(74) *Attorney, Agent, or Firm*—Fitch, Even, Tabin & Flannery; Norman N. Kunitz

(57) ABSTRACT

A shaft connecting device (18) having a thrust rod (8) and a lateral support (4) that fit into each other with minimal transverse play. In addition, the shaft connecting device (18) has a clamping device (16) with a stop arrangement (60, 60', 66) and a fixation arrangement (30, 30'), the latter connecting the lateral support (4) and the thrust rod (8) exclusively on their respective upper ends to each other. Any opening, closing and adjusting of the connections between the thrust rod (8) and the lateral support (4) is possible in a particularly simple and convenient manner. The lateral support (4) and the thrust rod (8) support each other, thus resulting in a high dynamic load-bearing capacity. The overall design is simple, clear and cost-effective.

22 Claims, 17 Drawing Sheets

SHAFT CONNECTING DEVICE FOR A HEALD SHAFT

CROSS-REFERENCE TO RELATED APPLICATION

This application claims the priority of European Patent Application No. 07 012 444.1, filed Jun. 26, 2007, the subject matter of which, in its entirety, is incorporated herein by reference.

BACKGROUND OF THE INVENTION

The invention relates to a shaft connecting device for a heald shaft of a weaving machine.

In most cases weaving machines comprise several heald shafts that are embodied by an essentially rectangular frame holding a large number of healds. The heald shafts usually have two shaft rods that are held horizontally during operation, said heald shafts being connected on their ends by vertically oriented lateral supports. These units are moved up and down in vertical direction by a shaft drive.

Such a heald shaft is disclosed, e.g., by document U.S. Pat. No. 6,378,564 B1. In order to move the heald shaft in vertical direction, its two lateral supports are connected on their respective lateral ends to a thrust rod. To do so, the thrust rod is connected to the carriage of a vertical guide. The lateral support of the heald shaft is also connected to the carriage of the vertical guide by means of a suitable hook.

For various reasons heald shafts need to occasionally be removed from the weaving machine and then set back into said machine. To achieve this, the connection between the thrust rod and the lateral support must be separated. This should be possible in the simplest manner and with only a few movements. On the other hand, it must also be possible to reliably re-establish the connection.

Document JP 9-21030 A discloses a heald shaft that comprises lateral supports that can be vertically shifted in a guided manner. On their upper ends, the lateral supports are braced with mounting blocks. The threaded free upper ends of the thrust rods are set into these bracing blocks and screwed with nuts to said blocks. The thrust rods are guided separately and are at a distance from the lateral supports.

A different concept is illustrated by utility model DE 91 03 031 U1. It uses as basis a heald shaft that is moved up and down by means of traction means. The traction means are ropes, for example. A traction means attaches to the upper end of the lateral support for moving and guiding the heald shaft, said traction means being fastened there by means of a clamping device.

Another concept is known from document EP 0 520 540 A1. It discloses heald shafts with hollow lateral supports, in which case a drive rod extends in vertical direction through the inside space of said lateral supports. The thrust rod has on its lower end a screw thread that is screwed to the lateral support. On the upper end of the lateral support an adjusting screw is provided, whereby the end face of said screw abuts against the end face of the thrust rod.

The examined Japanese utility model JP 06-38124 Y2 teaches that a thrust rod be configured in such a manner that it may receive the lateral support of a heald shaft in a positive-locking manner. A clasp with a clamping screw is used to fasten or unfasten the heald shaft. The thrust rod is guided by stationary guides and thus takes over guiding of the heald shaft. A height adjustment of shaft from the top is not possible.

It is the object of the invention to provide a shaft connecting device for a heald shaft of a weaving machine, said connecting device being constructed in a simple manner and for safe handling. In addition, the easiest possible handling is to be made possible.

SUMMARY OF THE INVENTION

The above object generally is achieved in accordance with invention by a shaft connecting device that comprises a lateral support that is vertically arranged during operation, and comprises a thrust rod with a free upper end, whereby, during operation, said thrust rod is driven vertically up and down on its lower end and whereby the largest part of the length of said thrust rod abuts against the lateral support. As a result of this, the thrust rod is stabilized and guided by the lateral support. For example, to achieve this, said thrust rod may extend through a hollow space or an inside space of the lateral support, whereby said rod abuts against the inside of the lateral support delimiting said hollow space. However, said thrust rod itself may also be hollow, e.g., have a U-shaped cross-section and enclose the lateral support. In both cases, the thrust rod and the lateral support extend around each other. Consequently, they mutually support each other.

A particularly simple embodiment of the invention is attained when the thrust rod has a rectangular cross-section with two flat sides facing away from each other, said flat sides abutting against two opposing interior sides of the lateral support, and when the thrust rod can move in a pendulum-like manner along said interior sides. A certain flexibility of the thrust rod then permits a flexible displacement of the thrust rod in the direction of the narrow sides of its rectangular cross-section. On the one hand, this permits a reliable transmission of the thrust force; on the other hand, the thrust rod may be connected—without intermediate guiding—to a hinge moved along an arcuate path.

In order to achieve a force-transmitting connection between the thrust rod and the lateral support, a clamping device is arranged on the upper end of the lateral support, preferably above the upper connection of the lateral support with the shaft rod, said clamping device being disposed to clamp the lateral support in place on the upper free end of the thrust rod. As a result of this, the respective heald shaft may be suspended from the top in the weaving machine. The adjustment means is associated with the lateral support. If the lateral support and the thrust rod are separated from each other, e.g., in order to remove the heald shaft from the weaving machine, the adjustment means, e.g., configured as a clamping device, remains on the lateral support.

Stop means on the lateral support and/or on the thrust rod limit the insertion of a heald shaft in downward direction into the weaving machine. These stop means additionally permit the height adjustment of the heald shafts relative to each other within a range of from 0 to 40 mm. To achieve this, the stop means may have a screw on the lateral support, said screw being supported so as to be adjustable relative to a stop edge or stop surface of the thrust rod. The height adjustment of a shaft may be fixed by means of a fixation device, e.g., in the form of a lock-nut. In order to facilitate the adjustment of the heights of the heald shafts, the lateral support or the thrust rod may be provided with a measuring scale. However, it is also possible to use other adjustment aids such as measuring means, templates, etc.

In order to fasten and/or adjust the height of the heald shaft, the operator only needs access to the clamping devices located on the upper side of the lateral supports. As soon as the operator has tightened the clamping device, a no-play connection has been established between the lateral support and the thrust rod. No access to the parts or elements below the heald shaft is necessary. This applies to the exchange of the heald shafts as well as to their height adjustment.

The heald shafts are solely driven via the lateral supports. No drive elements contact the heald shafts. This lowers the manufacturing costs.

Preferably, the lateral support is a bent sheet metal profile that represents, e.g., a U-profile rod having an open side facing the shaft rods. Such a lateral support can be manufactured in a simple and cost-effective manner. In addition, the shaft rod connections may consist of profile pieces that project from the open inside space of the U-profile-shaped lateral support and extend into the inside spaces of the shaft rods. The thrust rod may extend in longitudinal direction through the inside space of the U-profile rod. In so doing, it is preferred that the thrust rod abut at least against the two flat lateral limbs of the U-profile rod and optionally also against said rod's back. In so doing, the thrust rod may be configured as a full profile rod having different cross sections and having, e.g., a rectangular profile. Preferably, the entire surface of said thrust rod abuts against the inside surface of the U-profile rod.

In this case, the lateral support is preferably in engagement with a sliding guide device. A separate guide device for the thrust rod is not required. The thrust rod itself is guided by the lateral support.

It is also possible to configure the thrust rod as a U-profile rod that encloses the lateral support. In this case, the lateral support may be a full profile or also a U-profile rod. However, in conjunction with this, it is preferred that the upper end of the lateral support be a full profile rod to which the clamping device is attached. Considering this embodiment, the thrust rod may be in engagement with a sliding guide device. In this case, the thrust rods take over the driving function, as well as the guiding function, for the heald shafts.

The clamping device is preferably designed to brace the lateral support and the thrust rod relative to each other. This is preferably achieved directly in direct contact, without interposed elements. In the simplest case, the transmission of force occurs by frictional contact. To achieve this, the lateral support and the thrust rod each have a clamping surface. The two clamping surfaces are tensioned relative to each other and create the frictional contact.

It is also possible to provide the lateral support and the thrust rod with meshing teeth. Thus, the clamping device achieves a positive-locking connection between the thrust rod and the lateral support. The teeth permit a height adjustment in steps that correspond to the tooth spacing. This ensures a particularly reliable transmission of force.

The clamping device comprises a clamping wedge that is supported on an inclined surface, said surface being arranged in a manner inclined with respect to the thrust rod, and comprises a fixation means, e.g., in the form of a screw. By adjusting the fixation means, the clamping wedge—guided by its inclined surface—moves toward the thrust rod, clamping said rod in place. Both the end face of the clamping wedge and the end face of the thrust rod may have teeth that create connections that display a particular load-bearing capacity. As a result of this, positive-locking and non-positive locking connections are possible.

Additional details of advantageous embodiments of the invention are obvious from the drawings, the description or the claims. The description is restricted to essential aspects of the invention as well as to miscellaneous situations. The drawings contain additional details to which the person skilled in the art may refer, if necessary.

The drawings show exemplary embodiments of the invention.

BRIEF DESCRIPTION OF THE DRAWINGS

FIG. 17 is a view, horizontally in section, of the clamping device in accordance with FIG. 13.

DETAILED DESCRIPTION OF THE INVENTION

Figure 1:
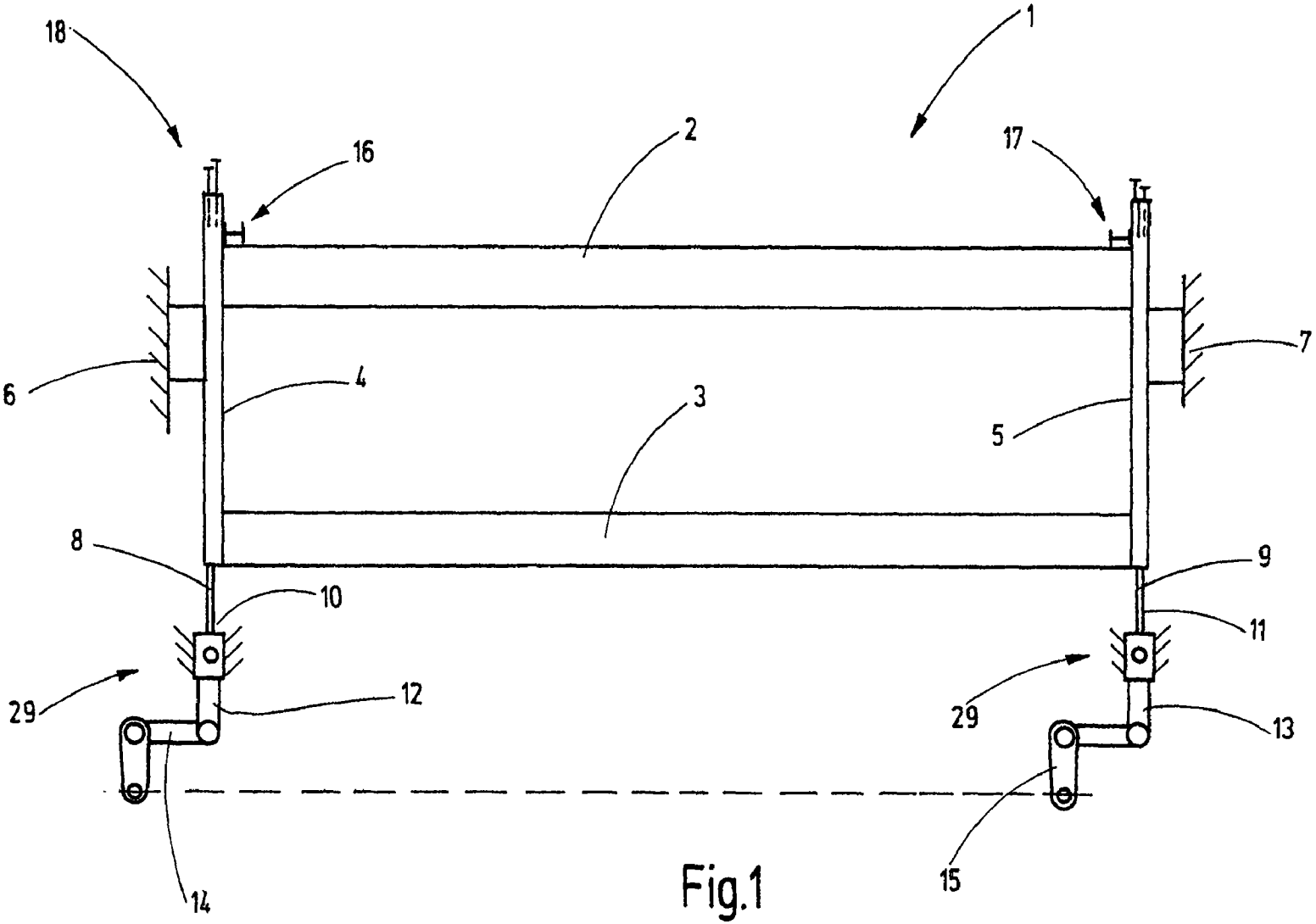
FIG. 1 is a schematic front view of a heald shaft.

FIG. 1 shows a heald shaft built into a weaving machine, said shaft being associated with an upper shaft rod 2 that is arranged horizontally during operation, with a lower shaft rod 3 arranged parallel at a distance from said latter rod, and with two lateral supports 4, 5 that connect the ends of the shaft rods 2, 3 to each other. Heald support rails are held on the shaft rods 2, 3, whereby vertically arranged healds extend between said support rails during operation.

The heald shaft 1 is supported so that it can be vertically shifted in appropriate guides 6, 7. The guides 6, 7 may be, e.g., sliding guides which support the lateral supports 4, 5, so that they can be shifted. The lateral supports 4, 5 are configured, e.g., as hollow profiles. Thrust rods 8, 9 extend through said profiles' interior spaces, whereby said thrust rods are driven on their lower ends 10, 11 in vertical direction, i.e., they oscillate up and down. To achieve this in the present exemplary embodiment, connecting rods 12, 13 are used, said connecting rods being connected to rectangular levers 14, 15.

A clamping device 16 is used to connect the lateral support 4 to the thrust rod 8. A clamping device 17 is used to connect the lateral support 5 to the thrust rod 9. Both clamping devices 16, 17 are preferably arranged above the upper shaft rod 2 on the respective lateral supports 4, 5. As a result of this, it is easier to access and handle them. The lateral support 4, 5 and the clamping device 16, 17 are configured so as to be essentially mirror-symmetrical. The subsequent description of the clamping device 16 thus applies analogously to the clamping device 17.

Figure 2:
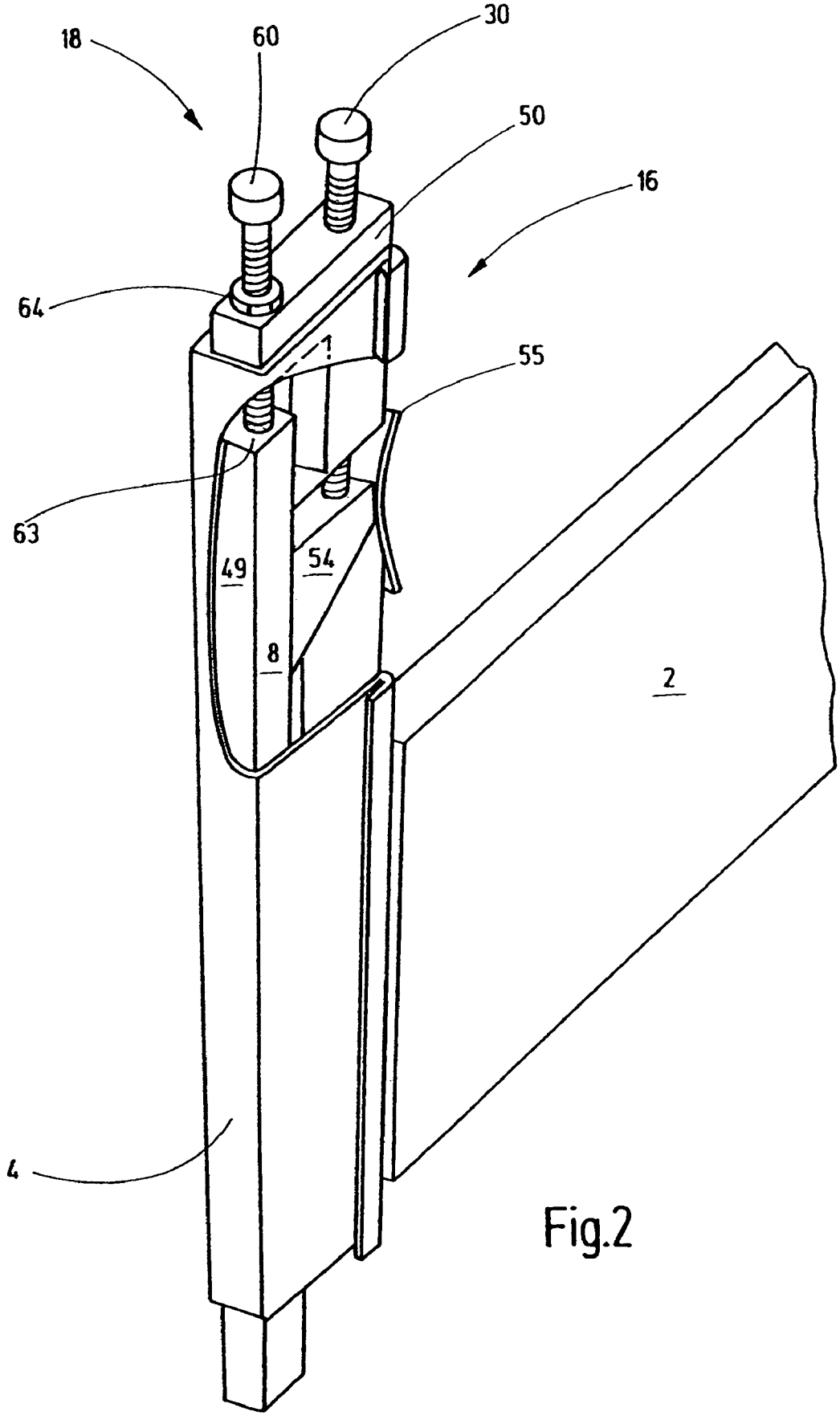
FIG. 2 is a detail of a simplified perspective schematic diagram of the heald shaft in accordance with FIG. 1.
Figure 4:
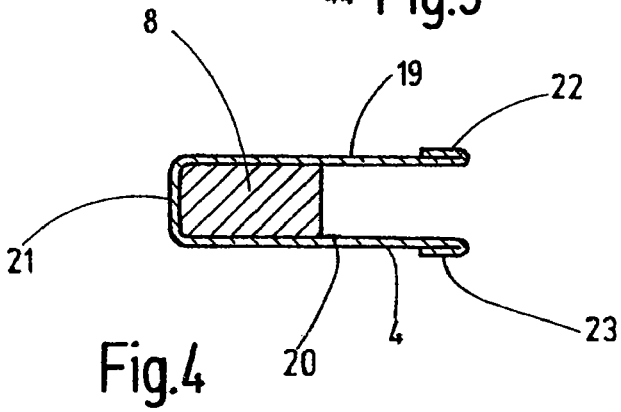
FIG. 4 is a view, horizontally in section, of the lateral support and the thrust rod of the heald shaft in accordance with FIG. 3.

Together with the lateral support 4 and the thrust rod 8, the clamping device 16 forms a shaft connecting device 18 as is shown in perspective in FIG. 2. Its details are obvious from the illustration of the heald shaft 1 and its specifics in accordance with FIGS. 3 through 7:

As is shown by FIG. 4, the lateral support 4 is a U-profile body with two limbs 19, 20 and a back in the form of a strip 21 connecting said limbs. For additional stiffening, the limbs 19, 20 are bent along their edges 22, 23. The lateral support 4 encloses an interior space, through which the thrust rod 8 extends. Preferably, the thrust rod 8 is arranged with minimal play in the lateral support 4, so that the thrust rod 8 and the inside of the limbs 19, 20, respectively, define a relatively narrow gap. Consequently, the thrust rod 8 can be easily moved back and forth in the lateral support 4 in longitudinal direction of the thrust rod 8.

Figure 5:
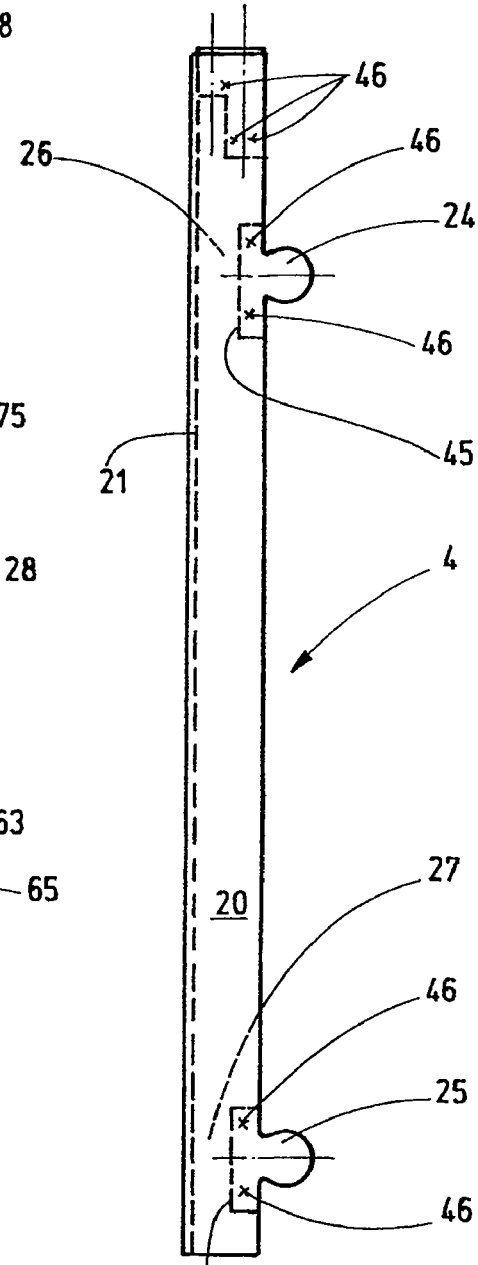
FIG. 5 is a front view of the lateral support of the heald shaft in accordance with FIG. 3.

FIG. 5 shows the lateral support 4 by itself. For attaching the shaft rods 2, 3, said lateral support has respectively one connecting piece 24, 25. The connecting pieces 24, 25 are held between the limbs 19, 20 and connected therewith by fastening means 46, e.g., weld spots. They leave one passage 26, 27, respectively, to the strip 21, whereby the thrust rod 8 may extend through said passage. In order to facilitate the insertion of the thrust rod into the passage 26, 27, the connecting pieces 24, 25 may have edges that are chamfered.

Figure 3:
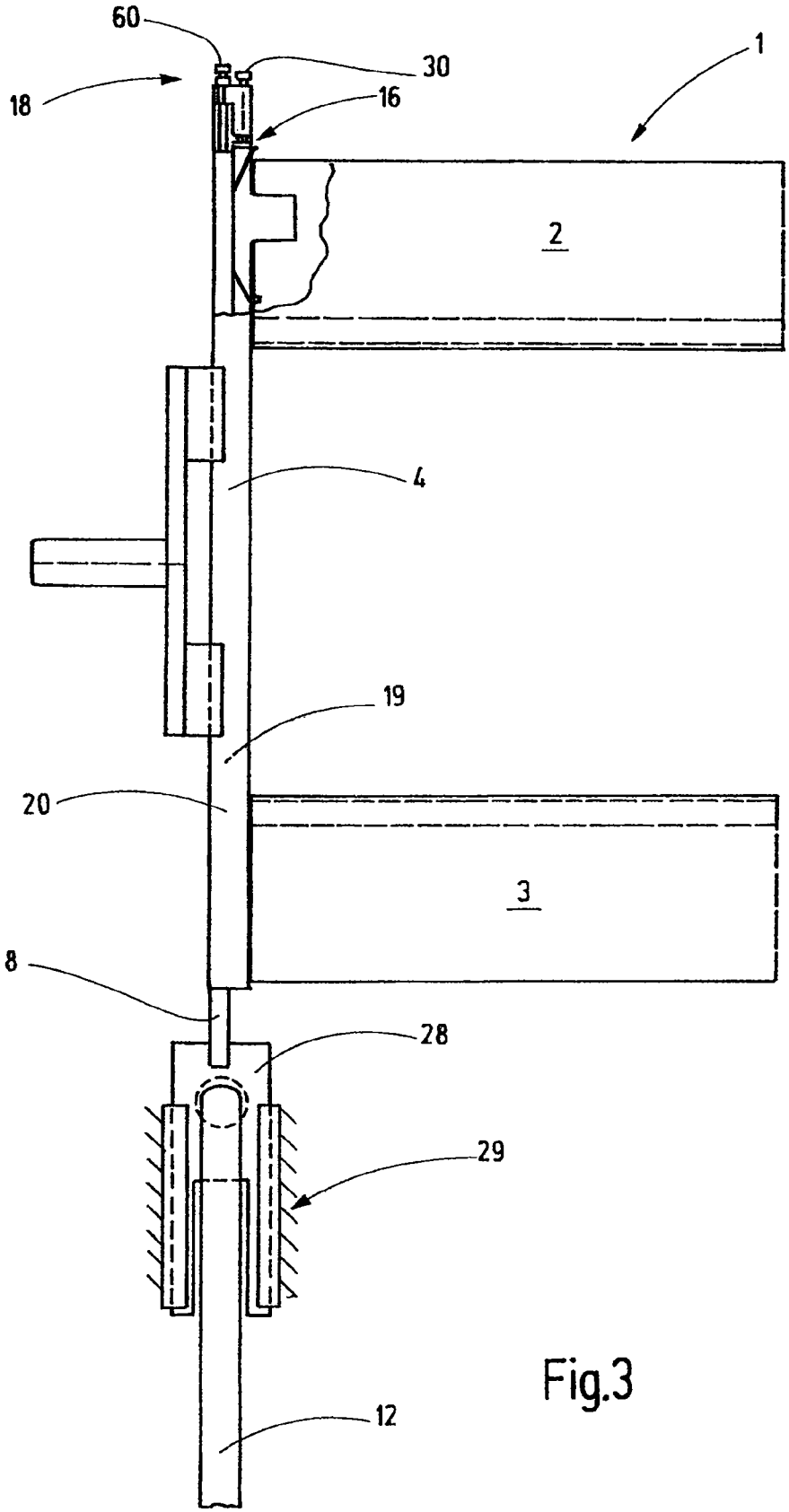
FIG. 3 is a front-side schematic diagram of the heald shaft in accordance with FIG. 1.
Figure 6A:
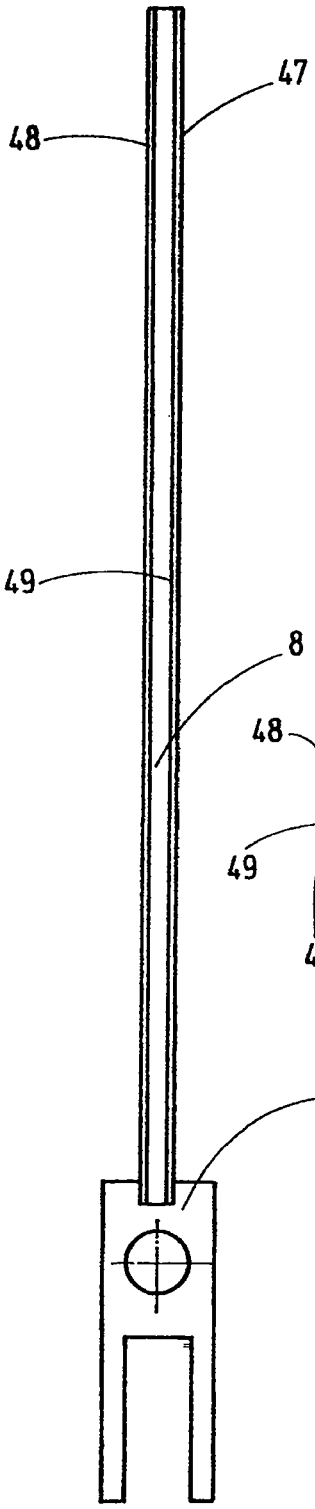
FIG. 6*a* is a front view of the thrust rod of the weaving machine in accordance with FIG. 3.
Figure 6C:
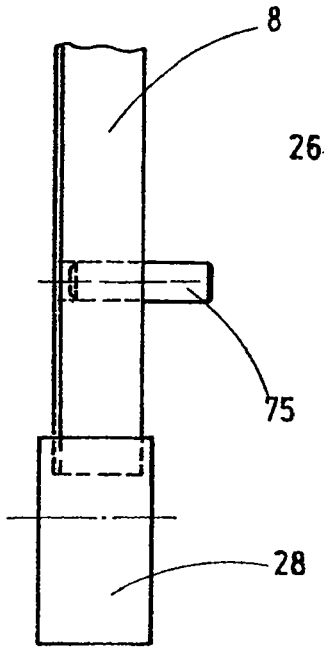
FIG. 6*c* is a side view of the thrust rod of the weaving machine in accordance with FIG. 3.
Figure 6B:
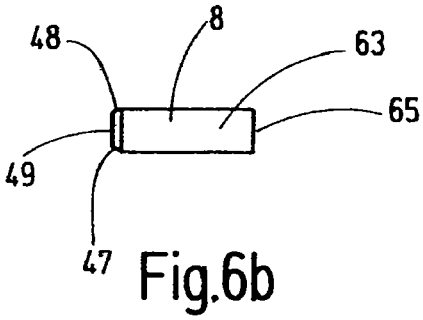
FIG. 6*b* is a plan view of the thrust rod of the weaving machine in accordance with FIG. 3.

FIG. 6 shows the thrust rod 8 by itself. It consists of a straight rod that preferably has a rectangular profile (FIG. 6*b*). The opposing flat sides of the thrust rod 8 are connected to the rear side 49 along chamfered edges 47, 48. Also, the upper end face 63 of the thrust rod 8 is connected to the rear side 49 via a chamfer. The insertion of the thrust rod 8 into the lateral support 4, in particular in the passage 26, 27, is facilitated by these chamfers 47, 48, as well as by the chamfers 44, 45 of the connecting pieces 24, 25. During operation, the rear side 49 of the thrust rod 8 abuts against the inside of the strip 21 of the lateral support 4. The thrust rod 8 is delimited, on the one end, by the rear side and, on the other end, by a narrow side 65. Preferably, the thrust rod 8 has a continuously constant cross-section along the entire length of said rod. Said thrust rod may be provided on its lower end with a connecting element 28 (FIGS. 6*a*, 6*c*) that may be allocated a separate linear guide 29 (FIG. 3). The connecting rod 12 may adjoin the connecting element 28 via a suitable hinge connection.

Figure 7A:
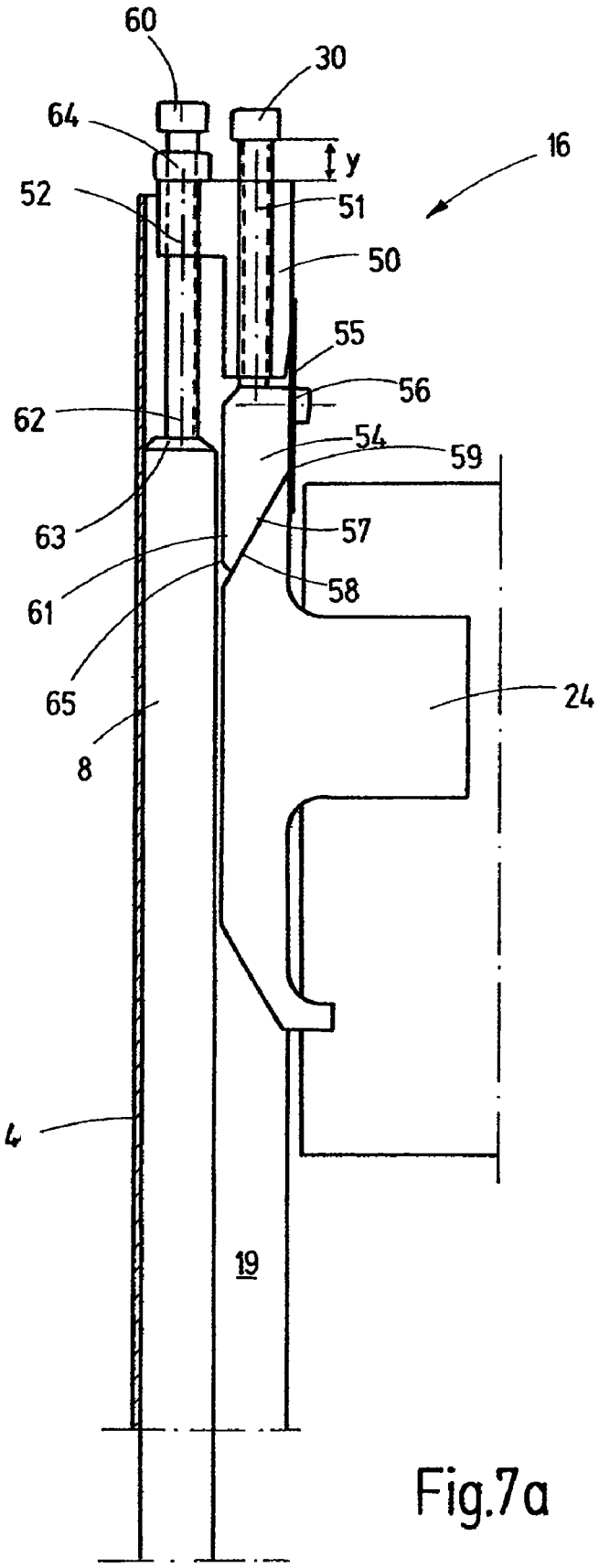
FIG. 7*a* is the clamping device in accordance with FIG. 3 in relaxed state, with an illustration of the inside edges.
Figure 7B:
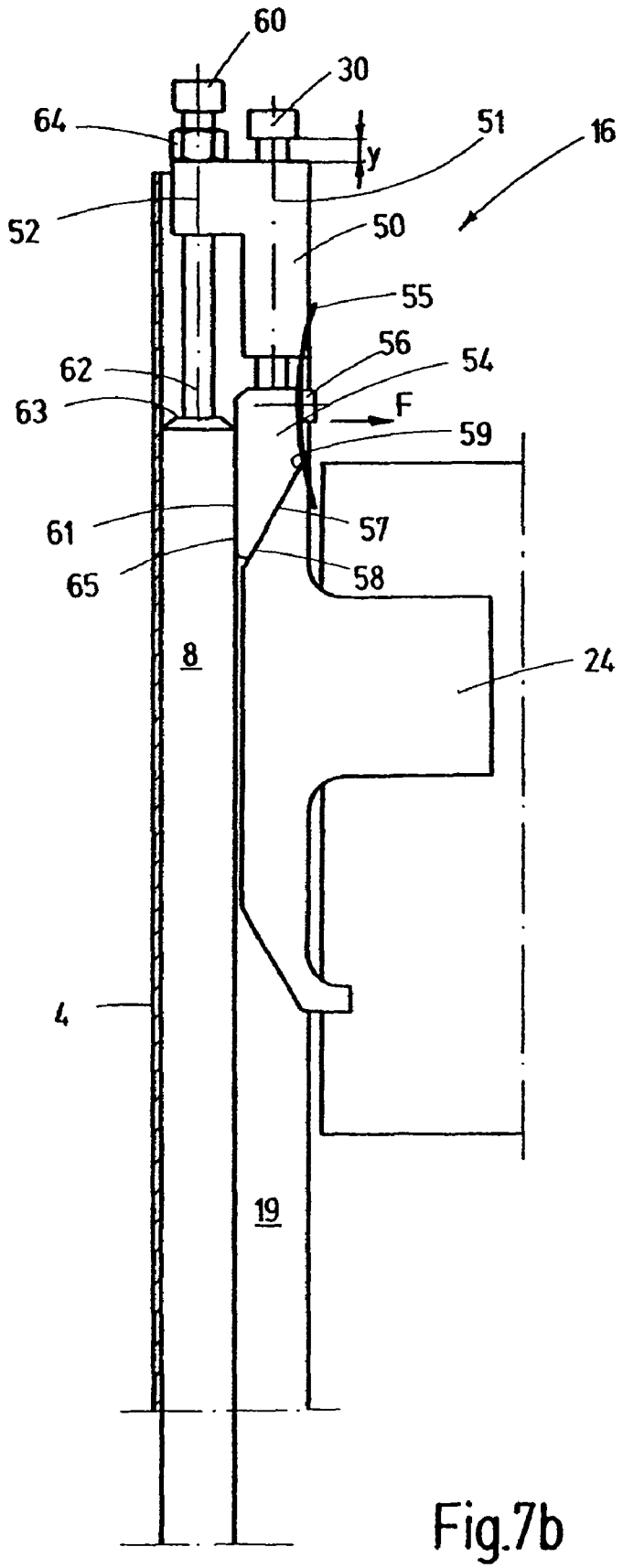
FIG. 7*b* is the clamping device in accordance with FIG. 3 in tensioned state, with an illustration of the inside edges.

A clamping device 16 is arranged on the upper free end of the lateral support 4 (FIG. 7*a*). The clamping device 16 has an insert 50 having the shape of a parallel epiped, said insert preferably consisting of a metallic material. This insert 50 is held in place between the two limbs 19, 20 of the lateral support 4 with the use of a known fastening means 46 (FIG. 5). The insert 50 may preferably have a threaded bore 51 for the accommodation of a fixation means 30. The fixation means 30 may be configured as a screw. The clamping device 16 also comprises a wedge piece 54 that is held in a movable manner between the two limbs 19, 20 of the lateral support 4. In so doing, the two flat sides of the wedge piece 54 may be in contact with the lateral surfaces 19, 20. The wedge piece 54 has, on its end face facing away from the fixation means 30, a wedge-shaped end 57. In relaxed mode, this wedge-shaped end may abut against a complementary abutment surface 58 of the connecting piece 24 or be at a minimal distance therefrom. The wedge piece 54 is held in a shiftable manner by a spring element 55, said spring element abutting against the end faces of the bent limbs 19, 20 of the edges 22, 23. The spring element 55 may have the form of a leaf spring and is connected to the wedge piece 54 by means of a holding means 56. In relaxed state (FIG. 7*a*), the first narrow side 59 of the wedge piece 54 may project beyond the opening of the U-shaped lateral support 4, but it may also be flush therewith. The second narrow side 61 of the wedge piece 54 is oriented in the direction toward the narrow side 65 of the thrust rod 8. If the fixation means 30 is adjusted, thus reducing the distance Y in FIGS. 7*a* and 7*b*, the wedge piece 54 moves—due to the interaction of its wedge-shaped end 57 with the abutment surface 58 of the connecting piece 24, said piece being rigidly connected to the shaft rod 2—in a direction transverse to the longitudinal direction of the lateral support 4 toward the thrust rod 8. The fixation means 30 may be adjusted until the thrust rod 8 is tightly clamped between the second narrow side 61 of the wedge piece 54 and the strip 21 of the lateral support 4 (FIG. 7*b*). As a result of this, the drive of the heald shaft 1 is ensured via the thrust rod 8 and the lateral support 4. Shifting of the wedge piece 54 in the direction of the thrust rod 8 causes a tensioning of the spring means 55. Thus, a force F (FIG. 7*b*) is generated, whereby the largest portion of said force acts in a direction transverse to the longitudinal direction of the lateral support 4 and counter the shifting direction of the wedge piece 54. Due to this force, the wedge piece 54 moves into its starting position (FIG. 7*a*) when the fixation means 30 is opened.

Figure 8A:
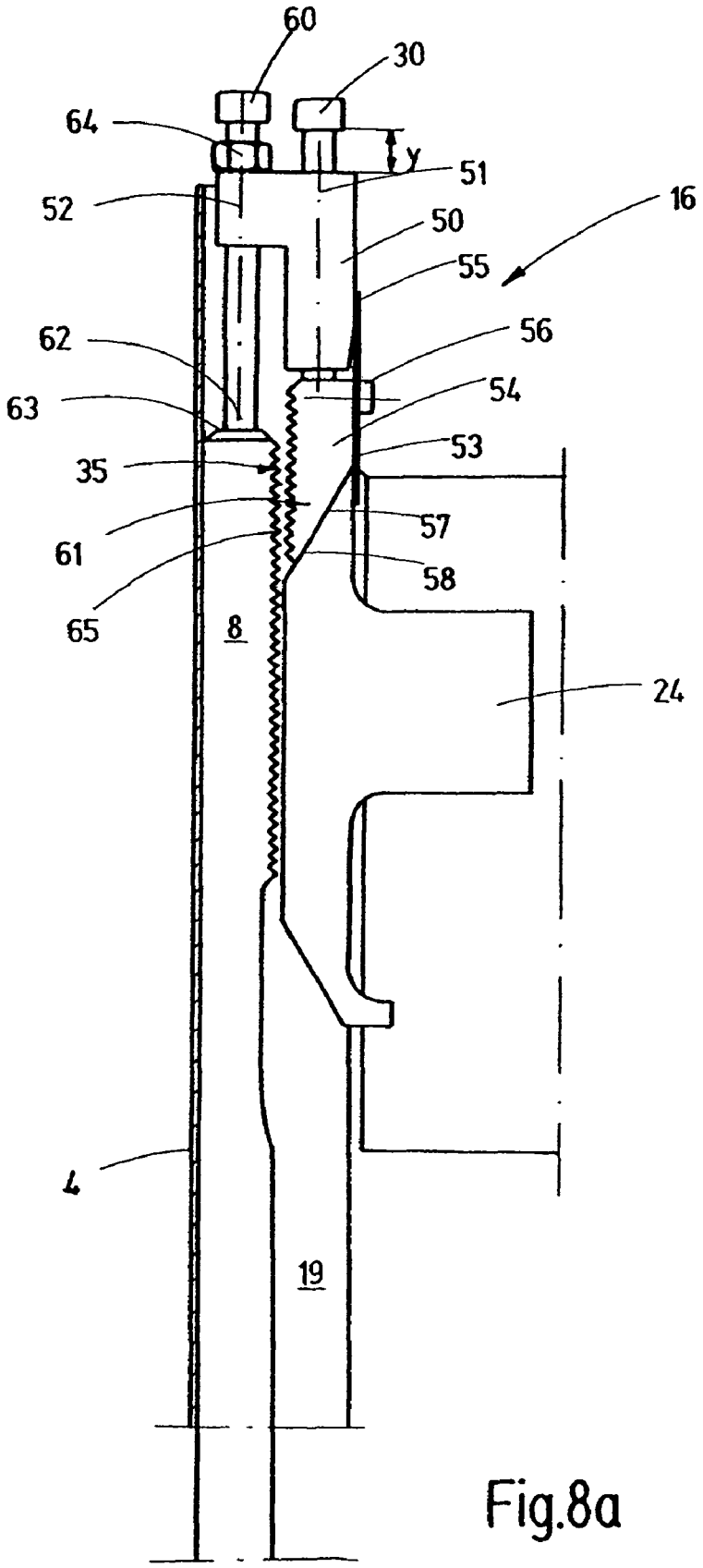
FIG. 8*a* is a modified embodiment of the clamping device in accordance with FIG. 3, in relaxed state, with an illustration of the inside edges.
Figure 8B:
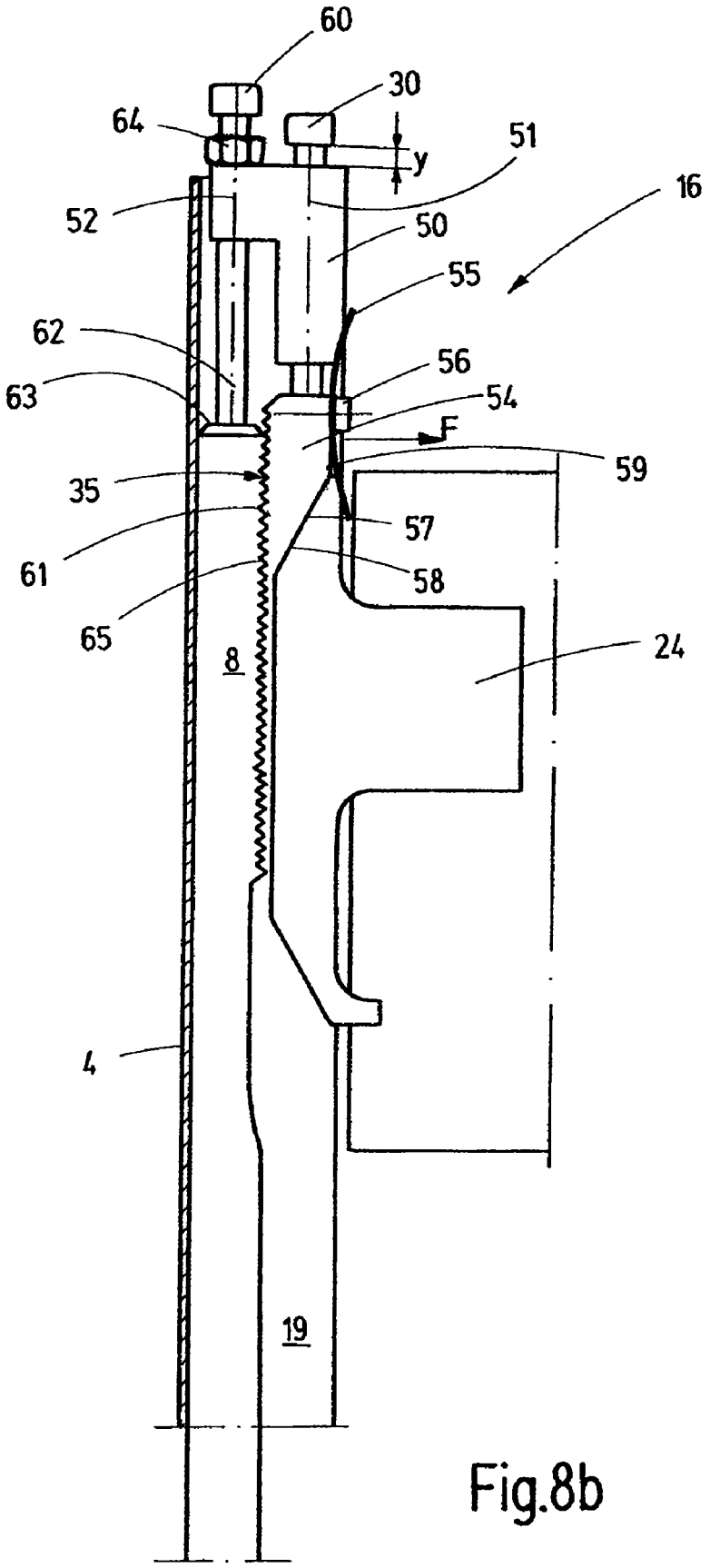
FIG. 8*b* is a modified embodiment of the clamping device in accordance with FIG. 3, in tensioned state, with an illustration of the inside edges.

FIGS. 8*a* and 8*b* show a different exemplary embodiment of the clamping device 16. With the exception of the second narrow side 61 of the clamping piece 54 and the narrow side 65 of the thrust rod 8 opposite said clamping piece, the clamping devices in accordance with FIGS. 7 and 8 are identical. The description is analogous with reference to the same reference numbers. In order to make possible a positive-locking connection of the clamping piece 54 with the thrust rod 8, i.e., the heald shaft 1 with the shaft connecting device 18, the second narrow side 61 of the clamping piece 54 and its opposing narrow side 65 of the thrust rod 8 has positive-locking means, e.g., in the form of teeth 35. As a result of this, a particularly strong, stable connection is possible. FIG. 8*a* shows the clamping device 16 in relaxed state, whereas FIG. 8*b* shows the clamping device 16 in tensioned state.

Figure 9A:
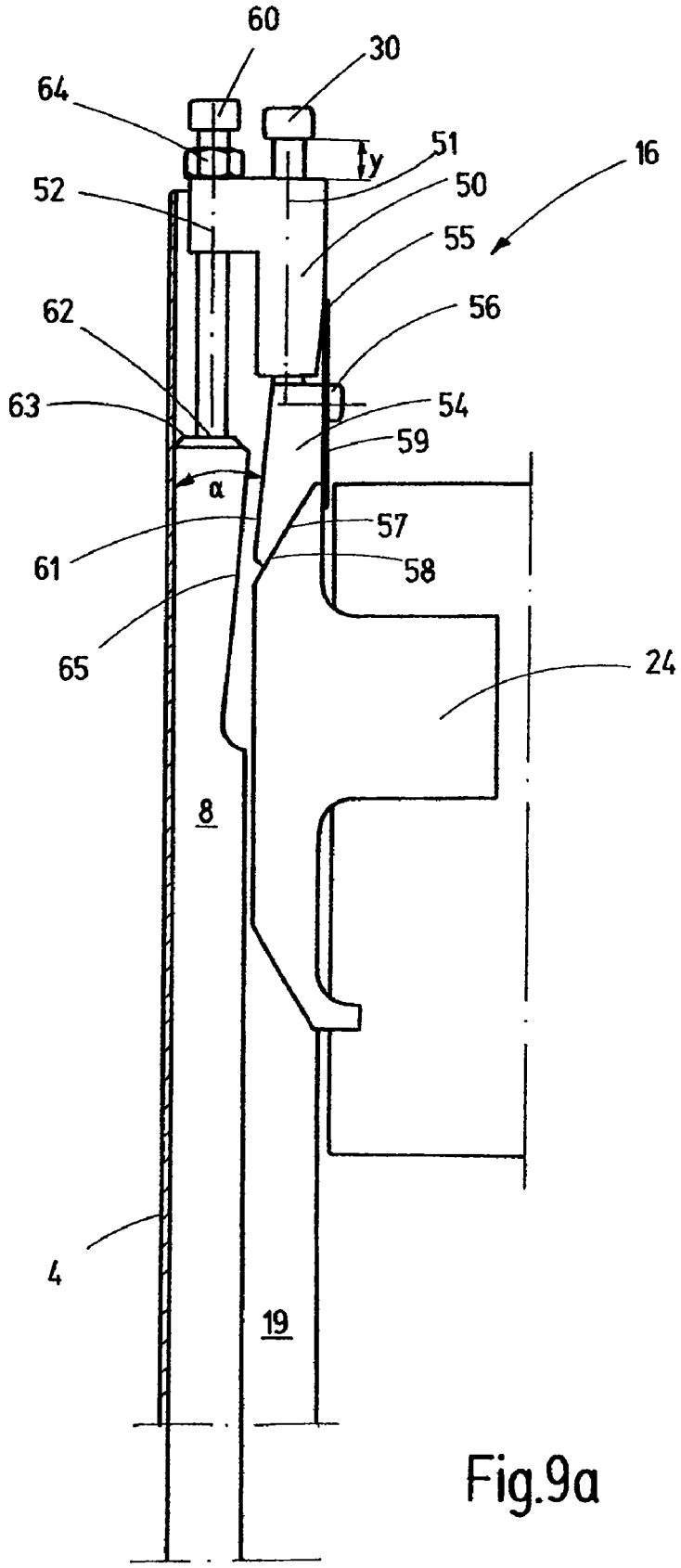
FIG. 9*a* is another modified embodiment of the clamping device in accordance with FIG. 3, in relaxed state, with an illustration of the inside edges.
Figure 9B:
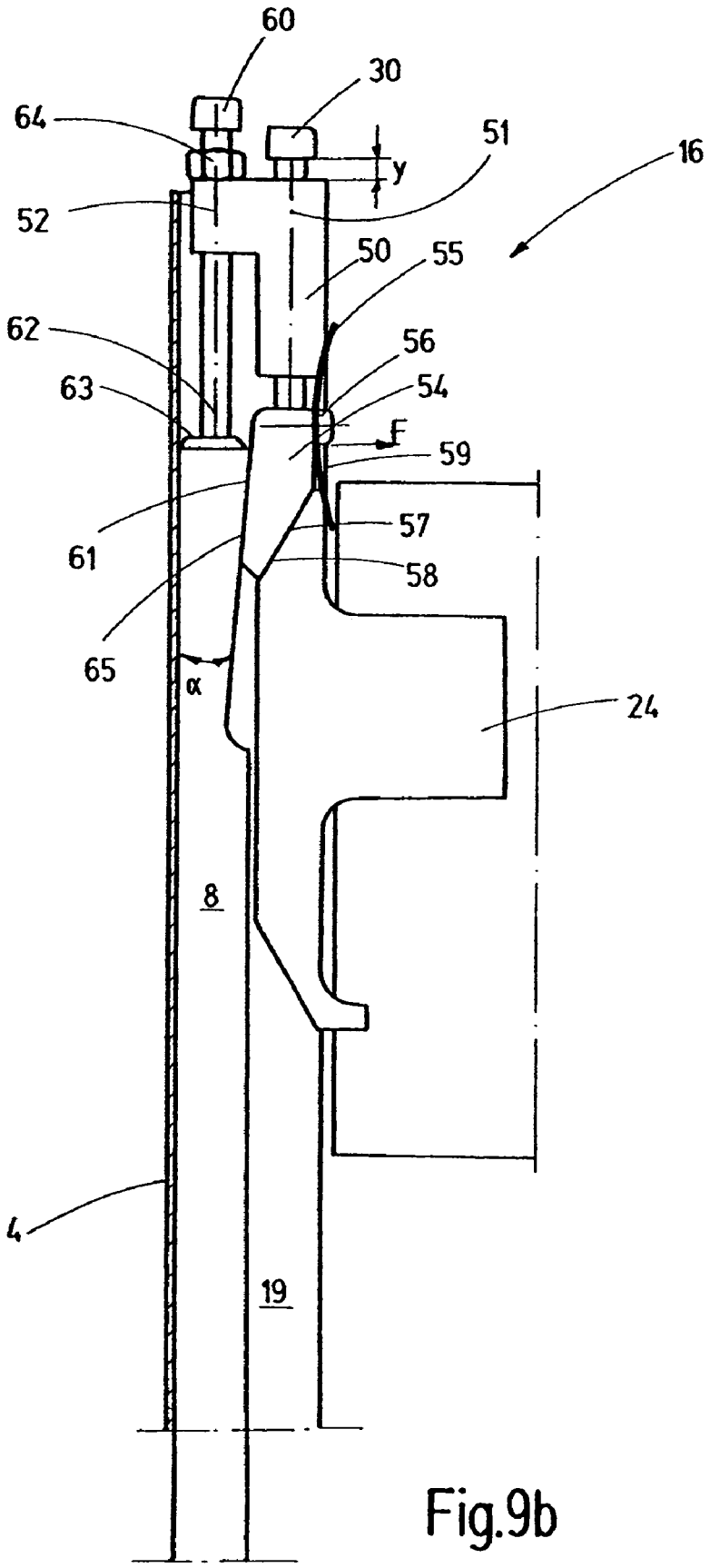
FIG. 9*b* is another modified embodiment of the clamping device in accordance with FIG. 3, in tensioned state, with an illustration of the inside edges.

FIGS. 9*a* and 9*b* show another exemplary embodiment of the clamping device 16. With the exception of the second narrow side 61 of the clamping piece 54 and the narrow side 65 of the thrust rod 8 opposite said clamping piece, the clamping devices in accordance with FIGS. 7 and 9 are identical.

The description is analogous with reference to the same reference numbers. In order to establish the positive-locking connection of the clamping piece 54 with the thrust rod 8, the second narrow side 61 of the clamping piece 54 is arranged at an acute angle α with respect to the back of the lateral support 4. The narrow side 65 of the thrust rod 8 is arranged so as to be complementary to the narrow side 61. If the distance Y is reduced by adjusting the fixation means 30, a clamping device 16 in accordance with FIG. 9 causes the thrust rod 8 to abut in a non-positive manner upward against an adjustment means 60. FIG. 9*a* shows the clamping device 16 in relaxed state, while FIG. 9*b* shows the clamping device 16 in tensioned state.

In addition to the fixation means 30, the clamping device 16 may comprise a stop means or a setting means, e.g., in the form of an adjustment means 60. As shown by FIG. 7, the adjustment means 60 may be a screw and be held so that it can be adjusted in longitudinal direction of the thrust rod 8. To do so, the insert 50 may have a second threaded bore 52 that receives the adjustment means 60. The adjustment means 60 can be adjusted in that a known device, e.g., a hexagonal socket, may be used on said device's one end. The adjustment means 60 has an abutment surface 62 on the end opposite the adjustment device of the adjustment means 60. This abutment 62 acts together with the end face 63 of the thrust rod 8. A holding means 64, e.g., in the form of a lock-nut, may be used to secure the adjustment means 60.

Figure 10A:
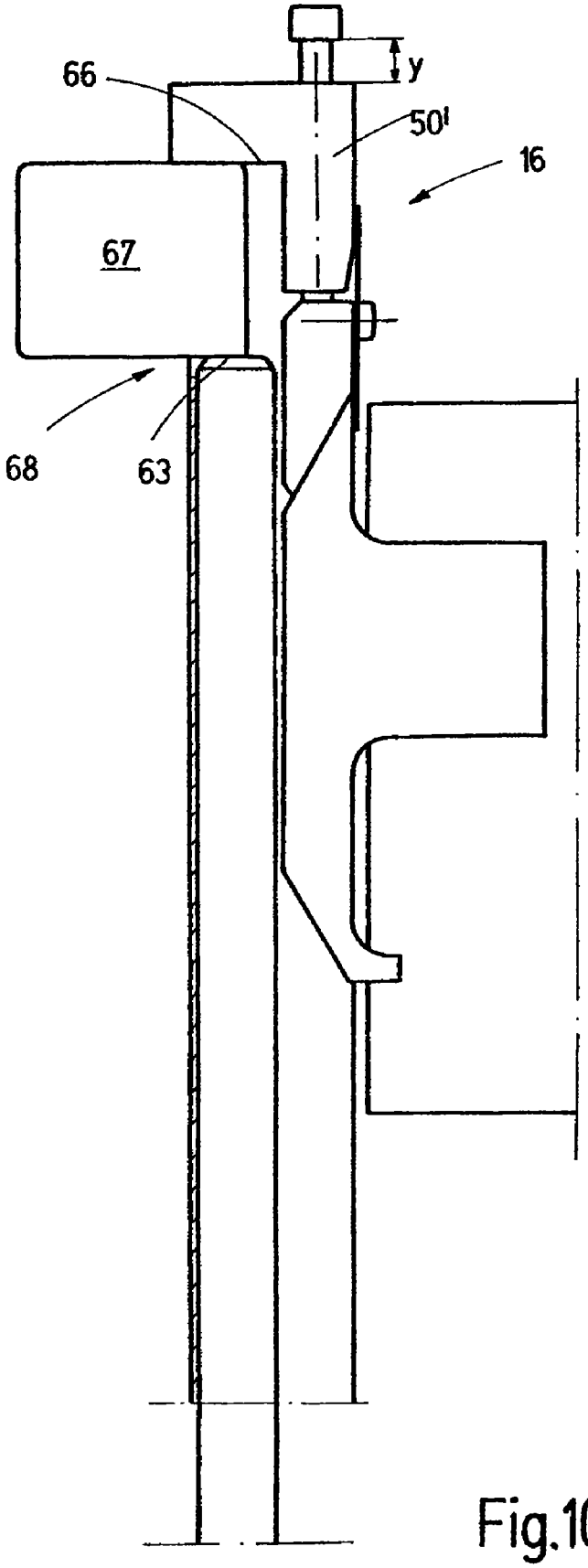
FIG. 10*a* is another modified embodiment of the clamping device in accordance with FIG. 3, in relaxed state, with an illustration of the inside edges.
Figure 10B:
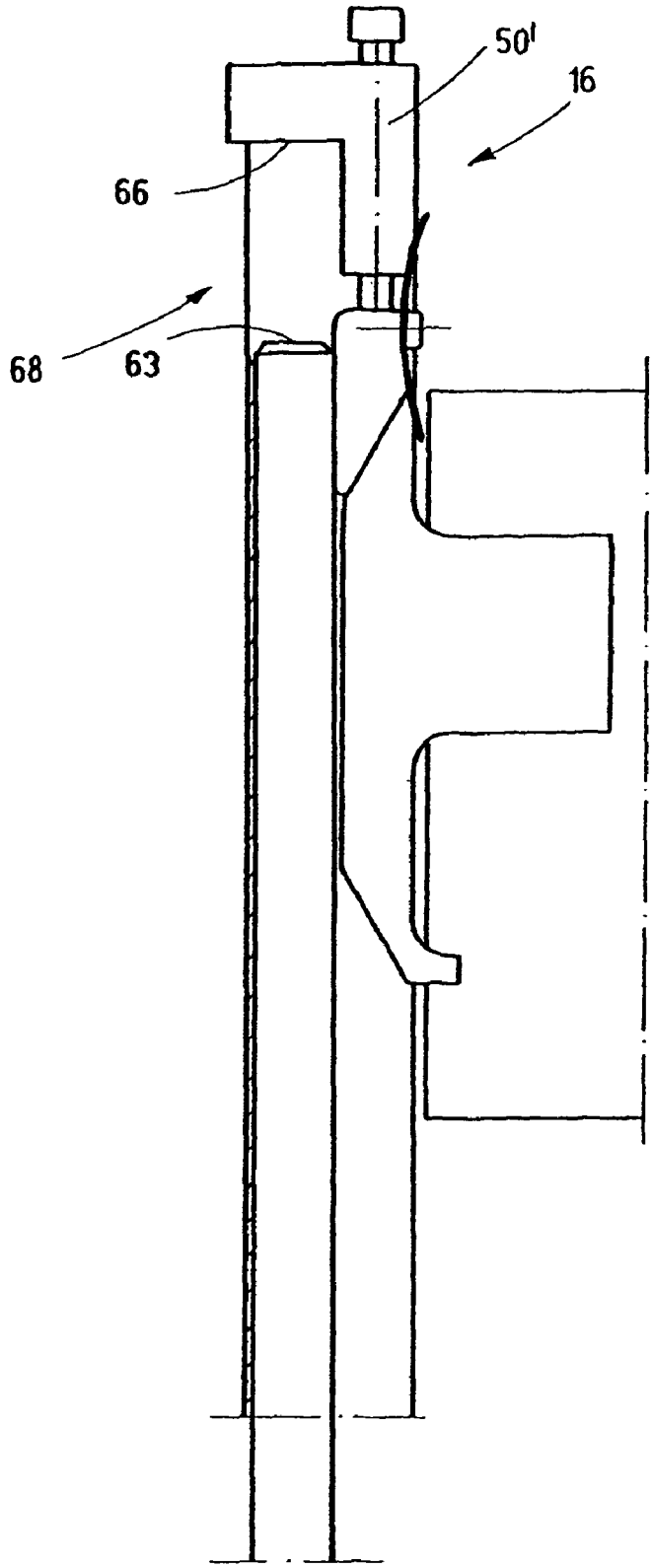
FIG. 10*b* is another modified embodiment of the clamping device in accordance with FIG. 3, in tensioned state, with an illustration of the inside edges.

FIG. 10 shows another exemplary embodiment of the clamping device 16. The insert 50' of the clamping device 16 comprises a simplified adjustment or setting device 60 in the form of a stop surface 66. This adjustment means is held in a stationary manner. The stop surface 66 is opposite the end face 63 of the thrust rod 8. The lateral support 4 has a recess 68 in its end region. A spacing means 67 can come into engagement with this recess 68 in order to fix the position of the heald shaft 1 with respect to the thrust rod 8. This permits the fast and easy adjustment of several heald shafts 1 on a weaving machine. Spacing means 67 having different heights may be used for the adjustment of different heights of several heald shafts 1. Other than that, referring to the exemplary embodiment in accordance with FIG. 10, the description—with reference to the same reference numbers—applies analogously.

It is also possible that the adjustment means 60 be provided on the thrust rod 8. In this case, the adjustment means is not a component of the clamping device 16. The adjustment means, for example in the form of a projection 75, is provided on the lower end of the thrust rod 8, as shown by FIG. 6*c*. The projection 75 may have the shape of a pin which is firmly seated in a corresponding bore in the thrust rod 8. The projection 75 may also be seamlessly attached in one piece to the thrust rod 8. An adjustment means designed in this manner prevents—during the insertion of the heald shaft 1—the lateral support 4 from falling downward over the thrust rod 8 of the heald shaft 1. Consequently, the heald shaft 1 is also prevented from coming into contact with the connecting element 28 when the heald shaft 1 is connected to the drive device of the weaving machine.

The shaft connecting device 18 described so far operates as follows:

During operation, the heald shaft 1 is connected to its drive device as shown by FIG. 3. To do so, the heald shaft 1 is pushed from the top over the thrust rod 8 and locked in place at the desired height by tightening the fixation means 30. Each driving movement of the thrust rod 8 is thus transmitted to the heald shaft 1. The thrust rod 8 is set between the limbs 19, 20. When it transmits thrust forces, said thrust rod cannot perform any lateral yielding movement. The driving movement is thus transmitted to the heald shaft 1 in a reliable manner and without play.

If the height of the heald shaft 1 is to be adjusted, the fixation means 30 is released and the lateral support 4 is moved up or down relative to the thrust rod 8. This shift may be done by means of the adjustment means 60. When the desired position has been reached, the fixation means 30 is fully tightened again. This also applies to the clamping device 17, which essentially comprises the features of the clamping device 16. Consequently, the above description applies analogously. For easy adjustment of the height of the heald shaft 1, the lateral support 4, 5 and/or the thrust rod 8, 9 may have marks (not illustrated), e.g., in the form of a measuring scale.

Figure 11:
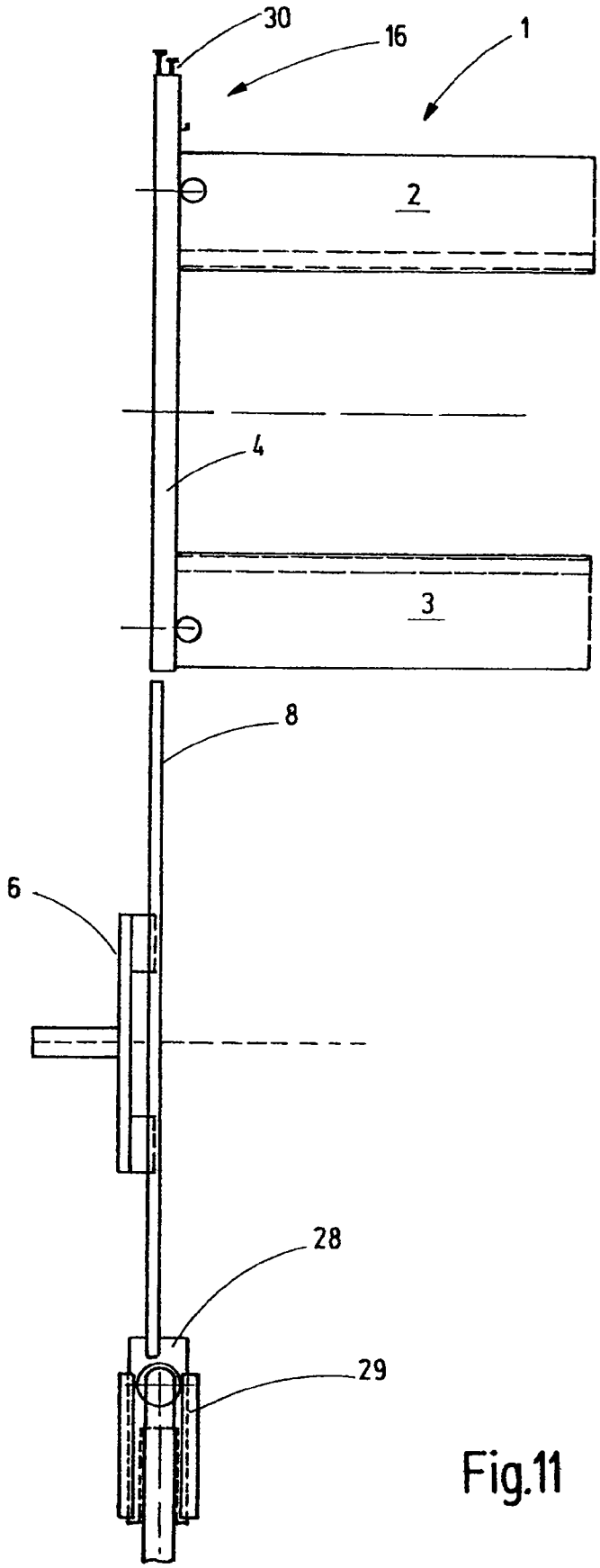
FIG. 11 is the heald shaft in accordance with FIG. 3, in an un-installed state.

For exchanging the heald shaft 1, the fixation means 30 of the clamping device 16, as well as the fixation means of the clamping device 17, are released. Then the heald shaft 1 may be pulled upward off the thrust rod 8 (and 9), as shown by FIG. 11. Subsequently, the same heald shaft 1, or also another heald shaft 1, may again be slid onto the thrust rod 8 (and 9) and be fixed in position at the desired height. When exchanging or separating a heald shaft 1 from the drive device or when adjusting the height of a heald shaft 1 with an inventive shaft connecting device 18, no other parts—other than opening the fixation means 30—need to be released or shifted, i.e., neither in longitudinal direction of the lateral support 4, 5 nor in longitudinal direction of a shaft rod 2, 3. The guides 6, 7, 29 may be held in a stationary manner. Still, it is possible to exchange the heald shaft 1.

It is understood that the description above and hereinafter of the shaft connecting device 18 relates in the same measure to the shaft connecting device of the lateral support 5. To this extent, a tightening of the clamping device 16 at the same time means a tightening of the clamping device 17. A release of the clamping device 16 at the same time means a release of the clamping device 17.

FIG. 11 shows the heald shaft 1 when it is separated from the thrust rod 8. Said heald shaft can now be replaced on the thrust rod 8 in that its lateral support 4 is slid over the thrust rod 8. It may then be locked at a desired working height as has been described above. As is obvious, the height adjustment of the heald shaft 1 and the exchange of said heald shaft do not require access to the space below the heald shaft 1. Therefore, handling of the shaft connecting device 18 in accordance with the invention is particularly convenient.

Figure 12:
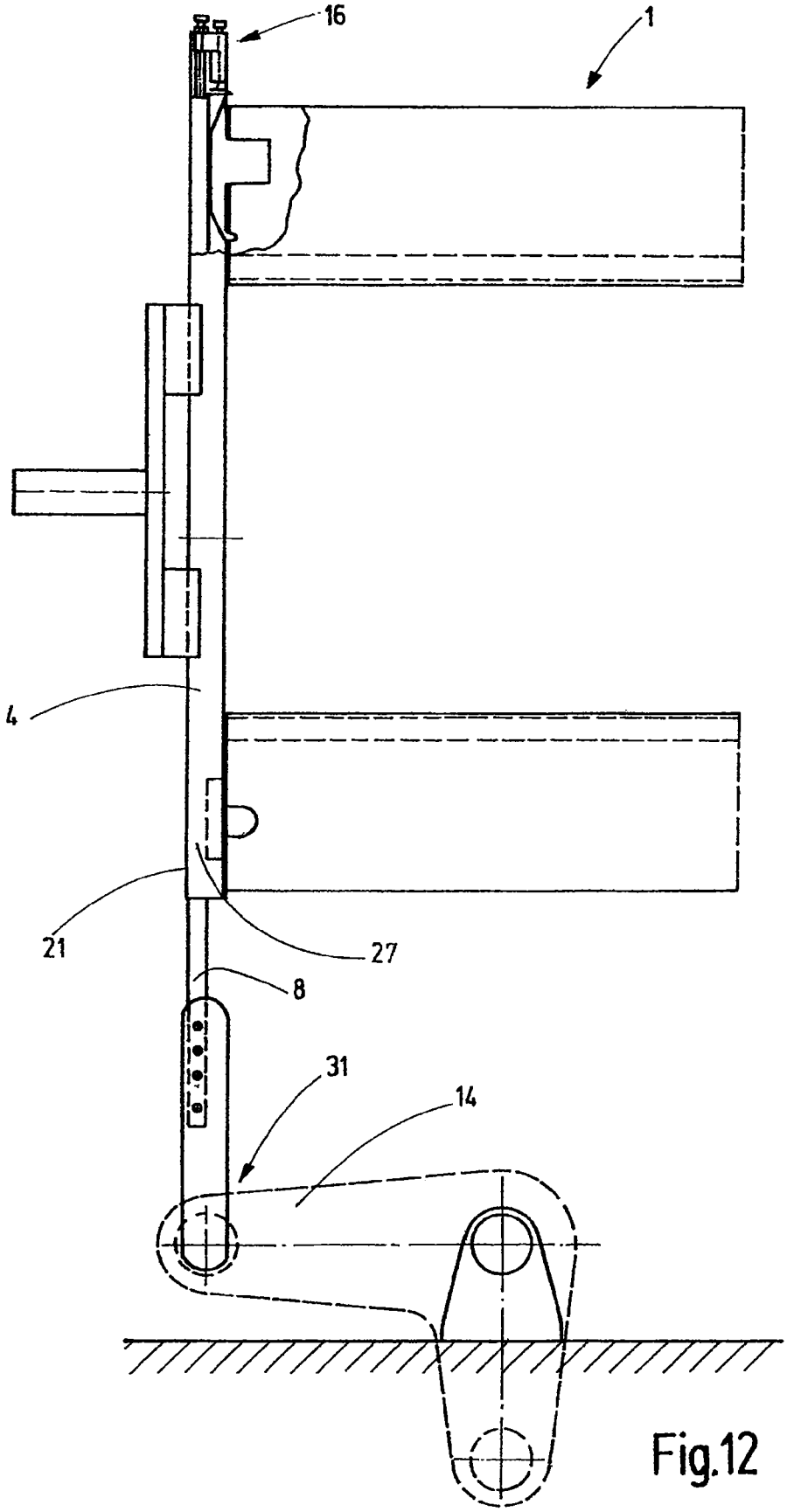
FIG. 12 is a front view of a modified embodiment of the heald shaft, similar to FIG. 3.

FIG. 12 shows a modified embodiment of the heald shaft 1. This embodiment differs from the above-described heald shaft 1 in that it does not have the connecting element 28, the linear guide 29 and the connecting rod 12. In this case, the thrust rod 8 is directly connected to the angular lever 14. The thrust rod 8 displays a certain flexibility or springiness that allows it to yield in the direction of the shaft rod 3 or the strip 21 of the lateral support 4. Consequently, the thrust rod 8 may follow—on its lower hinge point 31—the pivoting motion of the angular lever 14 in an oscillating manner. This is true in particular when the thrust rod 8 in the lateral support 4 can perform a pivoting movement. Then, the entire length from the clamping device 16 to the hinge point 31 is available for the flexible deflection and pivoting of the thrust rod 8. To achieve this, especially the lower passage 27—measured perpendicular to the strip 21—is wider than the width of the thrust rod 8 measured in the same direction. Likewise, the width of the passage 26 (FIG. 5) is preferably greater than the width of the thrust rod 8 that is to be measured in the same direction.

Figure 13:
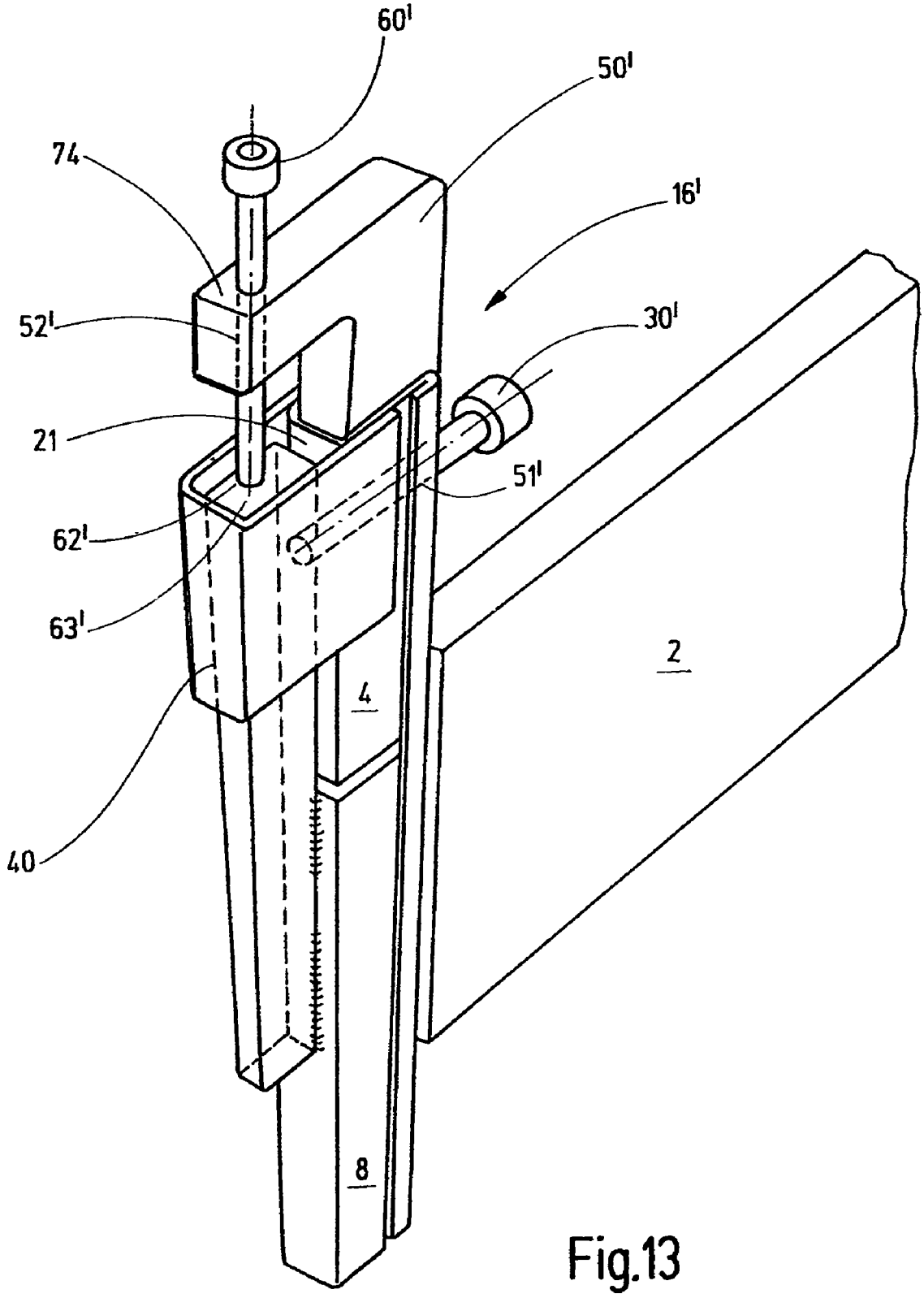
FIG. 13 is a detail of a simplified perspective schematic diagram of a modified embodiment of the heald shaft in accordance with FIG. 1.
Figures 14, 15:
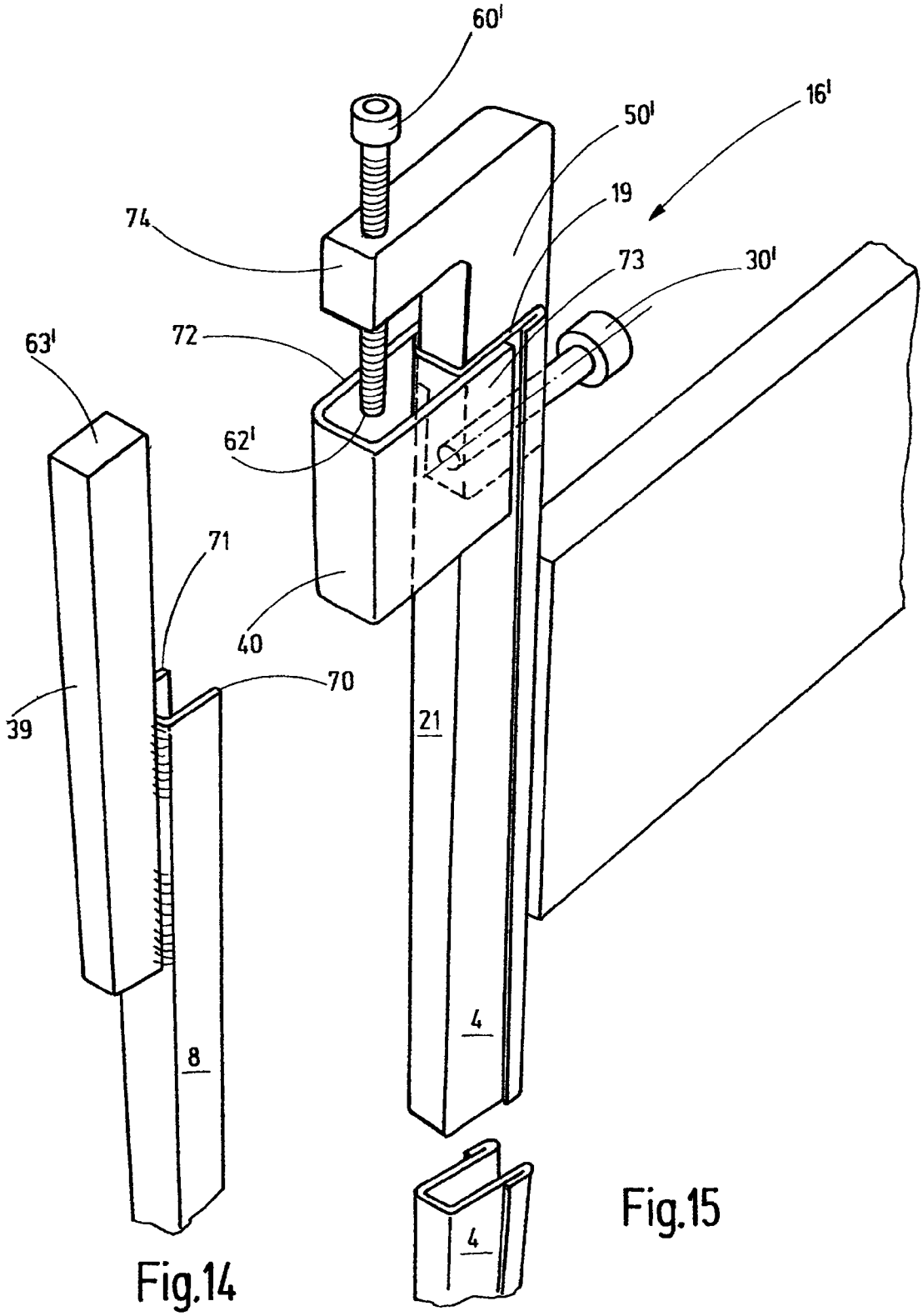
FIG. 14 is a perspective schematic diagram of the thrust rod of the weaving machine in accordance with FIG. 13.
FIG. 15 is a perspective schematic diagram of a modified embodiment of the lateral support with the clamping device in connection with the shaft rod in accordance with FIG. 13.
Figures 16, 17A, 17B:
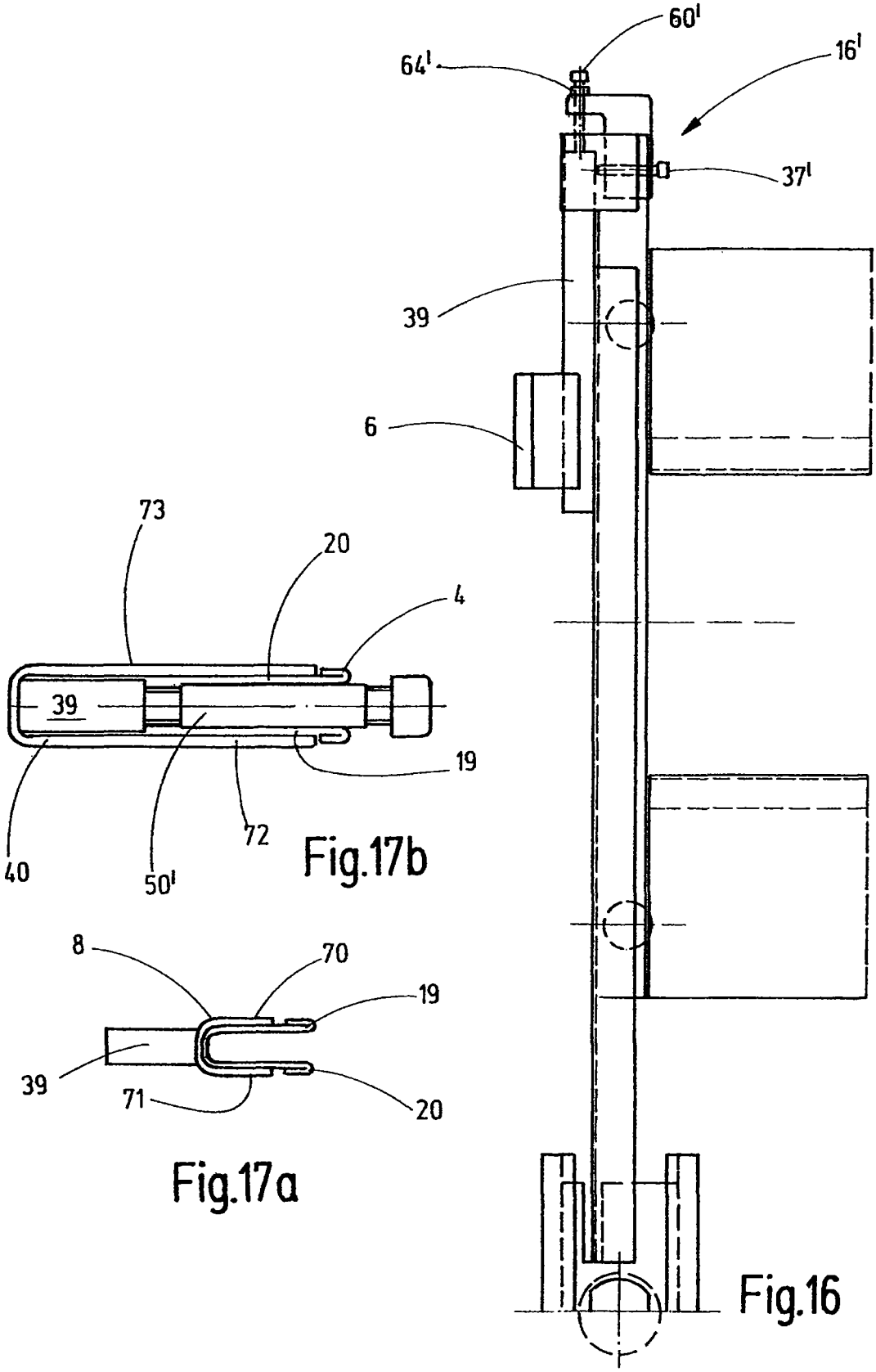
FIG. 16 is a front view of a modified embodiment of a heald shaft in accordance with FIG. 13, with a modified shaft connecting device.

FIGS. 13 through 17 show another embodiment of the invention. The special feature of this embodiment is that the lateral support 4 (FIG. 15), as well as the thrust rod 8 (FIG. 14), are configured as U-profiles. This provides a particularly stiff embodiment of the thrust rod 8 as well as of the lateral support 4. Referring to this embodiment, the limbs 70, 71 of the thrust rod 8 extend around the limbs 19, 20 of the lateral support 4. The lateral support 4 is arranged inside the thrust rod 8, as is particularly obvious from FIG. 17*a*. As is shown by FIG. 14, the thrust rod 8 is provided on its upper end with a full profile rod 39 that extends beyond said rod's upper end. The full profile rod 39 is, e.g., welded to the thrust rod 8 and represents the upper end of said rod. Said full profile rod may have a rectangular cross-section, for example. As is shown by FIG. 13, the lateral support 4 has on its upper end a U-shaped clamping collar 40. This extends beyond the back or the strip 21 of the lateral support 4, and its two limbs 72, 73 are connected to the limbs 19, 20 of the lateral support 4. A solid insert 50' is stationarily arranged between the latter, whereby the fixation means 30' is seated in a threaded bore 51', said fixation means 30' being movable in a direction transverse to the center axis of the thrust rod 8. As is shown by FIGS. 16 and 17*b*, said fixation means can be used to clamp the full profile rod 39 in place in the clamping collar 40 when the fixation means 30' is tightened. In addition, the full profile rod 39 may be in engagement with the sliding guide 6, as is shown by FIG. 16.

In accordance with FIGS. 13 through 17, the clamping device 16' may comprise an adjustment means 60' in addition to the fixation means 30'. As is shown by FIG. 13, the adjustment means 60' may have the form of a screw and be held so as to be adjustable in longitudinal direction of the thrust rod 8. To do so, the insert 50' may have a projection 74 that projects over the lateral support 4, and may have a second threaded bore 52' that receives the adjustment means 60'. For adjustment of the adjustment means 60', its end may have a known device, e.g., a hexagonal socket. The other end opposite the adjustment device of the adjustment means 60' has an abutment surface 62'. The abutment 62' acts together with the end face 63' of the thrust rod 8. A holding means 64', e.g., in the form of a lock-nut 64', may be used to secure the adjustment means 60.

The shaft connecting device 18 in accordance with the invention comprises a thrust rod 8 and a lateral support 4 that fit into each other with minimal transverse play. In addition, the shaft connecting device 18 comprises a clamping device 16 with a stop means 60, 60', 66 and a fixation means 30, 30', the latter connecting the lateral support 4 and the thrust rod 8 exclusively on their respective upper ends to each other. Any opening, closing and adjusting of the connections between the thrust rod 8 and the lateral support 4 is possible in a particularly simple and convenient manner. The lateral support 4 and the thrust rod 8 support each other, thus resulting in a high dynamic load-bearing capacity. The overall design is simple, clear and cost-effective.

It will be appreciated that the above description of the present invention is susceptible to various modifications, changes and modifications, and the same are intended to be comprehended within the meaning and range of equivalents of the appended claims.

LIST OF REFERENCE NUMBERS

1 Heald shaft
2 Shaft rod
3 Shaft rod
4 Lateral support
5 Lateral support
6 Guide
7 Guide
8 Thrust rod
9 Thrust rod
10 End
11 End
12 Connecting rod
13 Connecting rod
14 Angular lever
15 Angular lever
16 Clamping device
17 Clamping device
18 Shaft connecting device
19 Limb
20 Limb
21 Strip, back
22 Edge
23 Edge
24 Connecting piece
25 Connecting piece
26 Passage
27 Passage
28 Connecting element
29 Linear guide
30 Locking screw, fixation means
31 Hinge point
32
33
34
35 Teeth
36
37
38
39 Full profile rod
40 Clamping collar
41
42
43
44 Edges
45 Edges
46 Fastening means
47 Edge
48 Edge
49 Reverse side
50 Insert
51 Threaded bore
52 Threaded bore
53
54 Wedge piece
55 Spring means
56 Holding means
57 Wedge-shaped end
58 Abutment surface
59 First narrow side
60 Setting means, adjustment means
61 Second narrow side
62 Abutment surface
63 End face
64 Holding means
65 Narrow side
66 Stop surface
67 Spacing means
68 Recess
69
70 Limb
71 Limb

72 Limb
73 Limb
74 Projection
75 Projection

What is claimed is:

1. Shaft connecting device for a heald shaft of a weaving machine, comprising:

a lateral support which is vertically arranged during operation and which connects an upper shaft rod and a lower shaft rod to each other;

a thrust rod, which has an upper free end with an end face, is arranged abutting against the lateral support and is connected with its lower end, during operation, to a drive moving back and forth, and;

an adjustment means, which is associated with and arranged on the lateral support, for defining the height of the heald shaft with respect to the end face of the thrust rod, with said end face, when adjusting the height of the heald shaft, interacting with and being in contact with the adjustment means.

2. Shaft connecting device in accordance with claim 1, wherein the adjustment means is in direct contact with the end face of the thrust rod.

3. Shaft connecting device in accordance with claim 1, wherein the adjustment means is arranged on an upper end of the lateral support and in contact with the end face of the thrust rod in order to adjust the height of the heald shaft relative to the end face of the thrust rod.

4. Shaft connecting device in accordance with claim 1, wherein the adjustment means is held so as to be movable.

5. Shaft connecting device in accordance with claim 1, further comprising a clamping device that is arranged on an upper end of the lateral support in order to clamp the lateral support in place on the upper free end of the thrust rod.

6. Shaft connecting device in accordance with claim 5, wherein the clamping device is arranged above the upper shaft rod.

7. Shaft connecting device in accordance with claim 5, wherein the clamping device is arranged above the thrust rod.

8. Shaft connecting device in accordance with claim 1, wherein at least one of the lateral support and the thrust rod has a hollow profile, and is arranged so as to extend around the other.

9. Shaft connecting device in accordance with claim 1, wherein the lateral support is a U-profile rod whose open side faces the shaft rods.

10. Shaft connecting device in accordance with claim 9, wherein the thrust rod extends through the lateral support.

11. Shaft connecting device in accordance with claim 1, wherein the thrust rod is configured as a rectangular full profile rod.

12. Shaft connecting device in accordance with claim 1, wherein the lateral support is in engagement with a sliding guide device.

13. Shaft connecting device in accordance with claim 1, wherein the thrust rod is configured as a U-profile rod that extends around the lateral support.

14. Shaft connecting device in accordance with claim 1, wherein the lateral support is configured as a U-profile rod.

15. Shaft connecting device in accordance with claim 1, wherein the upper end of the thrust rod is a full profile rod.

16. Shaft connecting device in accordance with claim 1, wherein the thrust rod is in engagement with a sliding guide device.

17. Shaft connecting device in accordance with claim 15, wherein the full profile upper end of the thrust rod is in engagement with a sliding guide device.

18. Shaft connecting device in accordance with claim 5, wherein the clamping device is set up to tension the lateral support and the thrust rod relative to each other.

19. Shaft connecting device in accordance with claim 1, wherein the lateral support and the thrust rod are each provided with teeth on facing respective surfaces, which teeth, when engaged, clamp the lateral support and the thrust rod in engagement with each other.

20. Shaft connecting device in accordance with claim 5, wherein the clamping device is a wedge-type clamping device.

21. Shaft connecting device in accordance with claim 20, wherein the wedge-type clamping device comprises a wedge piece that is mounted on the lateral support and can be moved, by a fixation means, toward a surface of the thrust rod and, in so doing, abuts against an abutment surface mounted on the lateral support, with said abutment surface being arranged inclined with respect to the thrust rod.

22. Shaft connecting device in accordance with claim 2, wherein the adjustment means includes a block fixedly mounted on the lateral support above the end face of the thrust rod and a bolt threadingly engaged in a bore formed in the block, extending in a longitudinal direction of the thrust rod, and engaging said end face of said thrust rod, whereby axial movement of the bolt will adjust the height of the heald shaft relative to the end face of the thrust rod.

* * * * *